US011521540B2

(12) United States Patent
Muto et al.

(10) Patent No.: US 11,521,540 B2
(45) Date of Patent: Dec. 6, 2022

(54) DISPLAY DEVICE AND ELECTRONIC EQUIPMENT

(71) Applicant: CANON KABUSHIKI KAISHA, Tokyo (JP)

(72) Inventors: Takashi Muto, Kawasaki (JP); Yasuharu Ota, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/668,539

(22) Filed: Oct. 30, 2019

(65) Prior Publication Data

US 2020/0143736 A1 May 7, 2020

(30) Foreign Application Priority Data

Nov. 7, 2018 (JP) ..... JP2018-209929

(51) Int. Cl.
*G09G 3/22* (2006.01)

(52) U.S. Cl.
CPC ..... *G09G 3/22* (2013.01); *G09G 2310/0286* (2013.01); *G09G 2310/0297* (2013.01)

(58) Field of Classification Search
CPC ..... G09G 3/22; G09G 2310/0297; G09G 2310/0286
See application file for complete search history.

(56) References Cited

U.S. PATENT DOCUMENTS 7,561,127 B2 7/2009 Mori et al.
8,194,007 B2 6/2012 Mori et al.
10,482,822 B2 * 11/2019 Yamashita ..... G09G 3/3266
2002/0000970 A1 * 1/2002 Akimoto ..... G09G 3/3648 345/100
2004/0027364 A1 * 2/2004 Ohtani ..... G06F 1/3228 345/699
2004/0130542 A1 7/2004 Tanada
(Continued)

FOREIGN PATENT DOCUMENTS

JP H05-061060 A 3/1993
JP 2001-282188 A 10/2001
(Continued)

OTHER PUBLICATIONS

Aug. 5, 2022, Office Action in Japanese Patent Application No. 2018-209929.
(Continued)

*Primary Examiner* — William Lu
(74) *Attorney, Agent, or Firm* — Venable LLP

(57) ABSTRACT

A display device is provided. The device comprises a pixel array, a scanning circuit configured to select a row in the pixel array, and a signal output circuit configured to supply image signals to pixels arranged in the row selected by the scanning circuit. The device displays an image using pixels arranged between an initial line on one side in the pixel array and an end line succeeding the initial line on the other side. The scanning circuit includes a start designation circuit configured to designate the initial line, an end designation circuit configured to designate the end line and a shift register. The shift register is configured to start selection for writing the image signals from the initial line and sequentially select the rows between the initial line and the end line in one frame period for displaying one image.

15 Claims, 9 Drawing Sheets

(56) References Cited

U.S. PATENT DOCUMENTS

2004/0233226 A1* 11/2004 Toriumi ..... G09G 3/3648 345/690
2006/0071897 A1* 4/2006 Moon ..... G09G 3/3688 345/98
2006/0097974 A1* 5/2006 Hashimoto ..... G09G 3/3688 345/98
2006/0214873 A1* 9/2006 Park ..... G09G 5/006 345/1.1
2007/0195182 A1* 8/2007 Ito ..... H04N 5/23245 348/308
2008/0238852 A1* 10/2008 Tsai ..... G09G 3/20 345/98
2008/0303761 A1* 12/2008 Osawa ..... G09G 3/3685 345/87
2009/0213058 A1* 8/2009 Tajiri ..... G09G 3/3614 345/94
2010/0123730 A1* 5/2010 Wang ..... G06T 1/60 345/545
2010/0128019 A1* 5/2010 Harada ..... G09G 3/3611 345/212
2011/0122104 A1* 5/2011 Uehara ..... G09G 3/3622 345/204
2011/0122122 A1* 5/2011 Chen ..... G09G 3/3688 345/213
2011/0316823 A1* 12/2011 Otani ..... G09G 3/3688 345/204
2012/0062545 A1* 3/2012 Kim ..... G09G 3/3233 345/212
2012/0075280 A1* 3/2012 Liu ..... G09G 3/3696 345/212
2013/0266231 A1* 10/2013 Liu ..... G09G 5/12 382/232
2015/0054818 A1* 2/2015 Cho ..... G09G 3/3674 345/99
2017/0193892 A1* 7/2017 Ha ..... G09G 3/2092
2019/0355311 A1 11/2019 Ota et al.

FOREIGN PATENT DOCUMENTS

JP 2004-205725 A 7/2004
JP 2005-148558 A 6/2005
JP 2008-197675 A 8/2008
JP 2009-163172 A 7/2009
JP 2019-525248 A 9/2019
WO 2018/026809 A 2/2018

OTHER PUBLICATIONS

Oct. 21, 2022 Official Office Action in Japanese Patent Appln. No. 2018-209929.

* cited by examiner

DISPLAY DEVICE AND ELECTRONIC EQUIPMENT

BACKGROUND OF THE INVENTION

Field of the Invention

The present invention relates to a display device and electronic equipment.

Description of the Related Art

In display devices, there is known an "image retention" phenomenon in which, when the same character or image is displayed for a long time, the light emission characteristic of the area where the same thing is kept displayed changes, so that a slight luminance difference occurs between the area and the surroundings even while another image is displayed. Japanese Patent Laid-Open Nos. 2005-148558 and 2009-163172 describe that the position of a displayed image is shifted in accordance with the lapse of time or the like in order to suppress image retention.

SUMMARY OF THE INVENTION

In the display devices disclosed in Japanese Patent Laid-Open Nos. 2005-148558 and 2009-163172, the timing of inputting an image signal for displaying an image is shifted in one scanning period for displaying one image to shift the position of the displayed image. Therefore, since each scanning period requires a longer time than the period for inputting the image signal, it is difficult to increase the operation speed of the display device.

Some embodiments of the present invention provide a technique advantageous in suppression of image retention in a display device and high-speed operation thereof.

According to some embodiments, a display device comprising: a pixel array including a plurality of pixels arranged in a matrix; a scanning circuit configured to select a row in the pixel array; and a signal output circuit configured to supply image signals to the pixels, among the plurality of pixels, arranged in the row selected by the scanning circuit, wherein the device displays an image using the pixels arranged between an initial line on one end side in the pixel array and an end line succeeding the initial line on the other end side, the scanning circuit includes a start designation circuit configured to designate the initial line, an end designation circuit configured to designate the end line, and a shift register circuit, and the shift register circuit is configured to start selection for writing the image signals from the initial line, and sequentially select the rows between the initial line and the end line in one frame period for displaying one image, is provided.

Further features of the present invention will become apparent from the following description of exemplary embodiments (with reference to the attached drawings).

DESCRIPTION OF THE EMBODIMENTS

Figure 1:
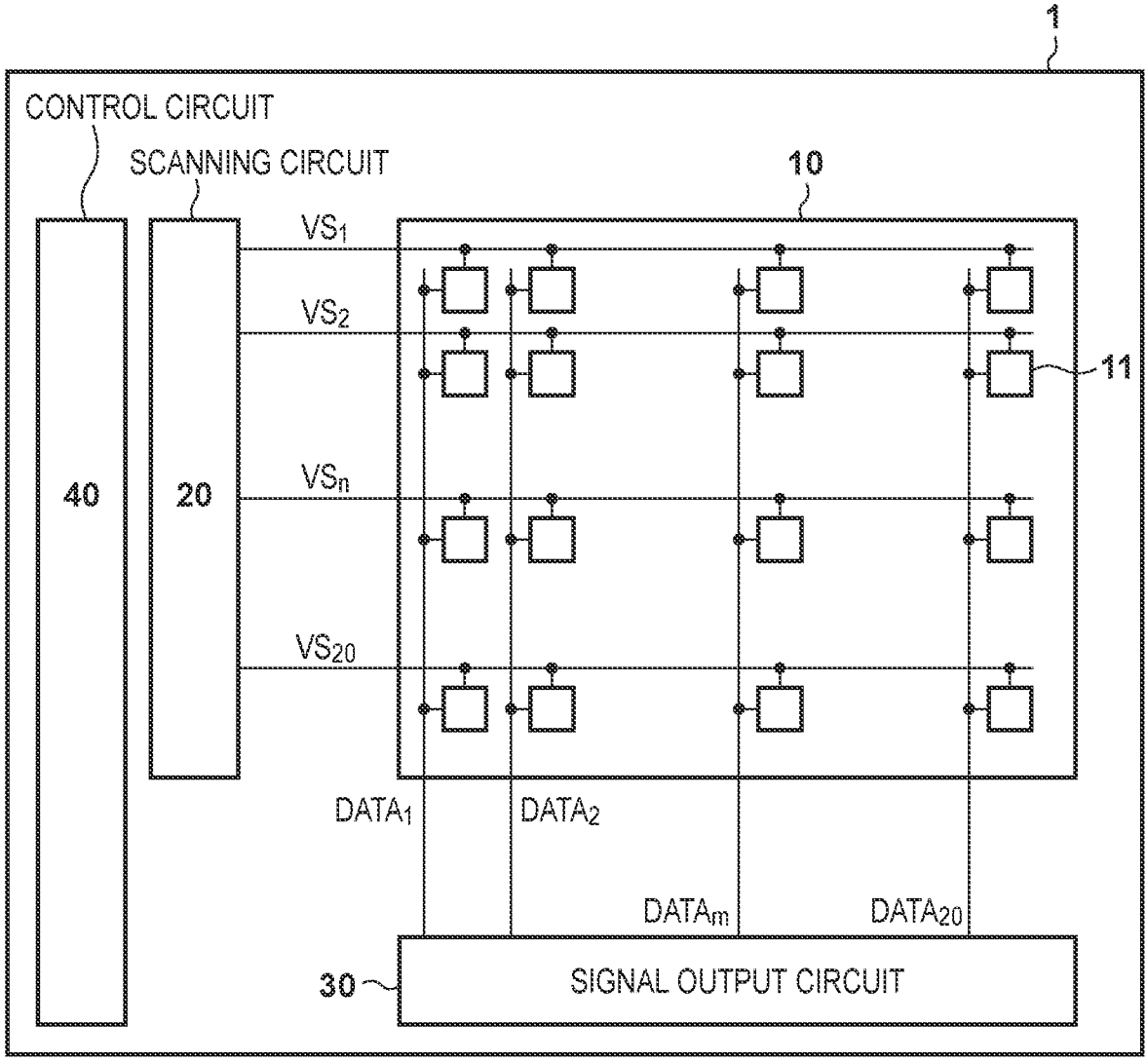
FIG. 1 is a view showing an arrangement example of a display device according to an embodiment of the present invention.

A detailed embodiment of a display device according to the present invention will be described below with reference to the accompanying drawings. Note that in the following description and drawings, common reference numerals denote common components throughout a plurality of drawings. Hence, the common components will be described by cross-referring to the plurality of drawings, and a description of components denoted by common reference numerals will appropriately be omitted.

With reference to FIGS. 1 to 8, the arrangement of a display device according to the embodiment of the present invention will be described. FIG. 1 is a view schematically showing the arrangement of a display device 1 of the present invention. The display device 1 includes a pixel array 10, a scanning circuit 20, a signal output circuit 30, and a control circuit 40.

The pixel array 10 includes a plurality of pixels 11 arranged in a matrix. In this specification, for the sake of easy understanding, the pixel array 10 is described to include the pixels 11 of 20 columns×20 rows. However, the number of pixels 11 arranged in the pixel array 10 is not limited to this.

Scanning lines 12 provided in common for each row in the pixel array 10 are connected to the pixels 11. In this specification, the horizontal direction in FIG. 1 may be referred to as a row direction and the vertical direction may be referred to as a column direction. The scanning circuit 20 is controlled by the control circuit 40, and outputs scanning signals $VS_1$ to $VS_{20}$ to the respective scanning lines 12. Here, $VS_n$ represents the scanning signal for the nth row. The scanning signals $VS_1$ to $VS_{20}$ control the writing and light emission of the pixels 11 for each row. The scanning circuit 20 can also be referred to as a vertical scanning circuit.

Signal lines 13 provided in common for each column are connected to the pixels 11. The signal output circuit 30 is controlled by the control circuit 40, and outputs image signals $DATA_1$ to $DATA_{20}$ to the signal lines 13. Here, $DATA_m$ represents the image signal for the mth column. When the scanning circuit 20 selects a row in the pixel array, the pixels 11 are set in a writing state, and the image signals $DATA_1$ to $DATA_{20}$ are supplied from the signal output circuit 30 to the pixels 11 arranged in the selected row. Further, when the pixels 11 are controlled to be set in a light emission state by the scanning circuit 20, the pixels 11 emit light based on the written signals.

Figure 2A:
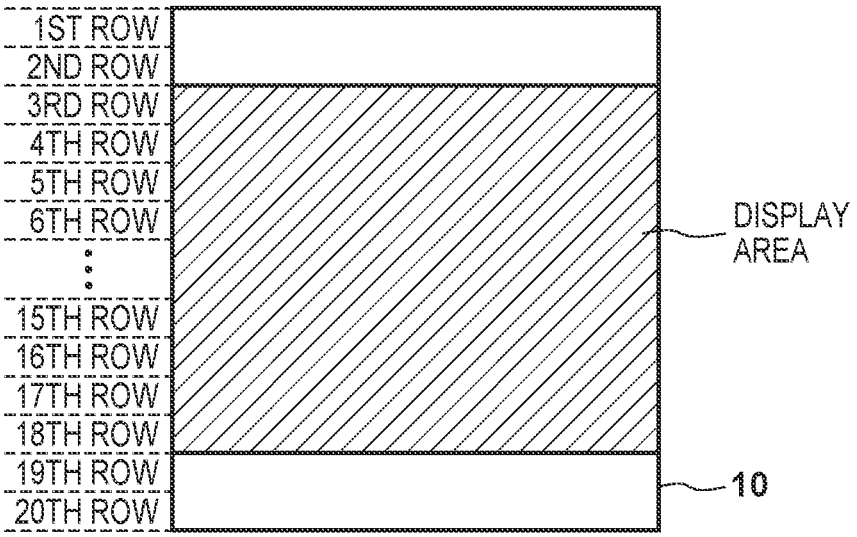
FIGS. 2A to 2C are views for explaining the shift of an image display position in the display device shown in FIG. 1.
Figure 2B:
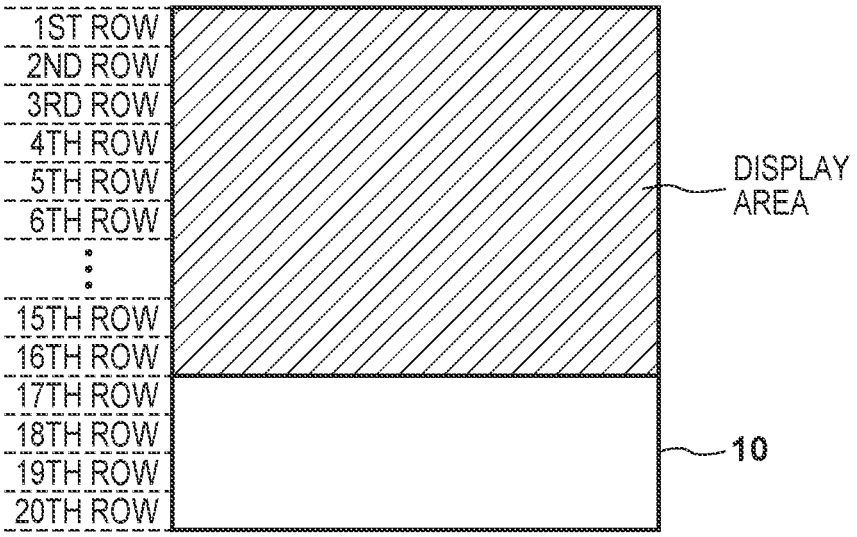
Figure 2C:
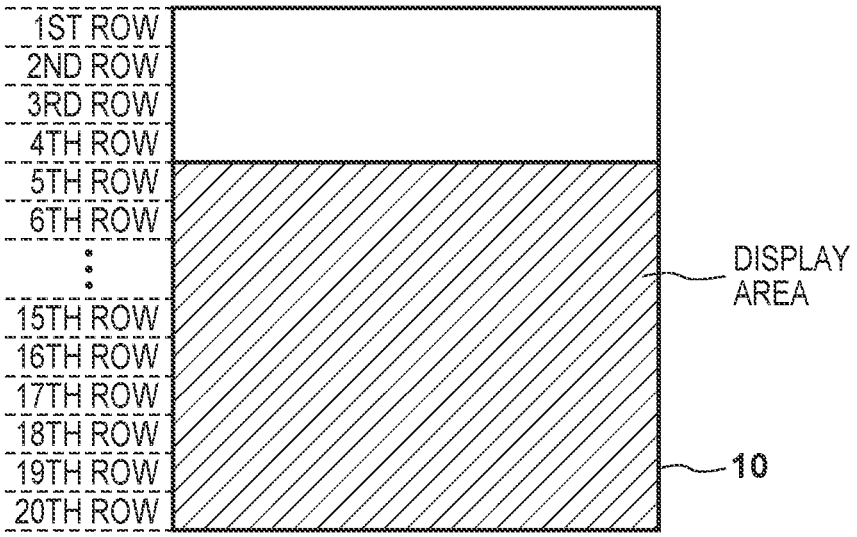

The display device 1 has a function of shifting an image display position by controlling the scanning circuit 20 by the control circuit 40 in order to suppress an image retention phenomenon. FIGS. 2A to 2C are views for explaining the shift of an image display position.

The control circuit 40 controls the scanning circuit 20 and the signal output circuit 30 using various signals such as a clock signal VCLK, a start pulse signal VST, and a reset signal VRES to be described later.

In this embodiment, the display device 1 displays an image using some continuous rows in the pixel array 10. In the display device 1 that includes the pixel array 10 including 20 rows×20 columns, assume that, for example, image signals for displaying an image that uses 20 rows×16 columns are input. The input image signals are supplied to the pixels 11 arranged in predetermined 20 rows×16 columns in the pixel array 10, and the image is displayed. Here, an area where an image is displayed is referred to as a display area. A display area that includes, for example, the third to 18th rows in the pixel array 10 is shown in FIG. 2A. Using this display area as a reference, that is, as an area shifted by ±0 rows, the image display area shifted by −2 rows and the image display area shifted by +2 rows are shown in FIGS. 2B and 2C, respectively. When the display area is shifted by −2 rows, the image is displayed in the first to 16th rows. On the other hand, when the display area is shifted by +2 rows, the image is displayed in the fifth to 20th rows. That is, as shown in FIGS. 2A and 2C, the row serving as an initial line from which the image display is started in the pixel array 10 may be different from the row arranged in an end on the first row side (one end side) in the pixel array 10. Further, as shown in FIGS. 2A and 2B, the row serving as an end line at which the image display ends in the pixel array 10 may be different from the row arranged in an end on the 20th row side (the other end side) in the pixel array 10.

In this manner, by shifting the display area so as not to keep outputting the same image to the predetermined pixels 11, image retention in the pixel array 10 is suppressed. Here, in the description of the shift of the display area, the shift amount is set to be ±2 rows with the area shifted by ±0 rows as a reference. In the following description, the shift amount described above is supposed as an example, but the shift amount and the size of the display area are not limited thereto. The number of rows in the display area is only required to be smaller than the number of rows in the pixel array by one or more. The shift amount may be, for example, ±1 rows, or may be appropriately set depending on the number of rows in the pixel array and the number of rows in the display area.

Figure 3:
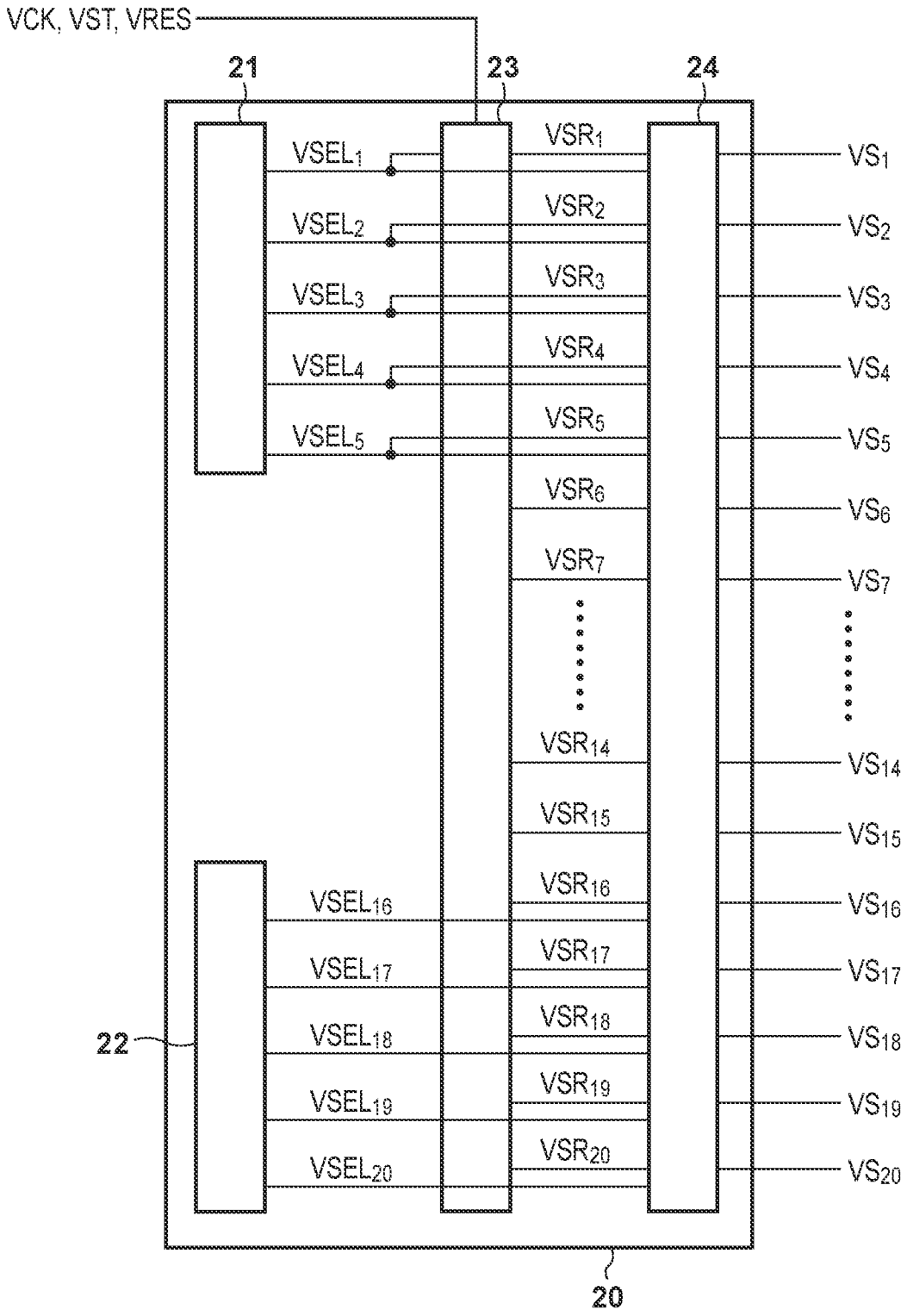
FIG. 3 is a view showing an arrangement example of a scanning circuit of the display device shown in FIG. 1.

FIG. 3 is a view showing an arrangement example of the scanning circuit 20. The scanning circuit 20 includes a start designation circuit 21, an end designation circuit 22, a shift register circuit 23, and a light emission control circuit 24. The start designation circuit 21 designates the initial line of a display area to display an image in the pixel array 10 by selection signals $VSEL_1$ to $VSEL_5$. The end designation circuit 22 designates the end line of a display area to display an image in the pixel array 10 by selection signals $VSEL_{16}$ to $VSEL_{20}$. The shift register circuit 23 outputs signals $VSR_1$ to $VSR_{20}$ to perform scanning for writing image signals starting from the selected initial line. The light emission control circuit 24 outputs scanning signals $VS_1$ to $VS_{20}$ for scanning from the initial line to the end line based on the signals $VS_1$ to $VSR_{20}$. Thus, the display device 1 displays an image using the pixels 11 arranged from the initial line on the first row side (one end side) to the end line on the 20th row side (the other end side) in the pixel array 10. Here, $VSEL_n$ represents a selection signal corresponding to the nth row, and $VSR_n$ represents a signal corresponding to the nth row.

Figure 4:
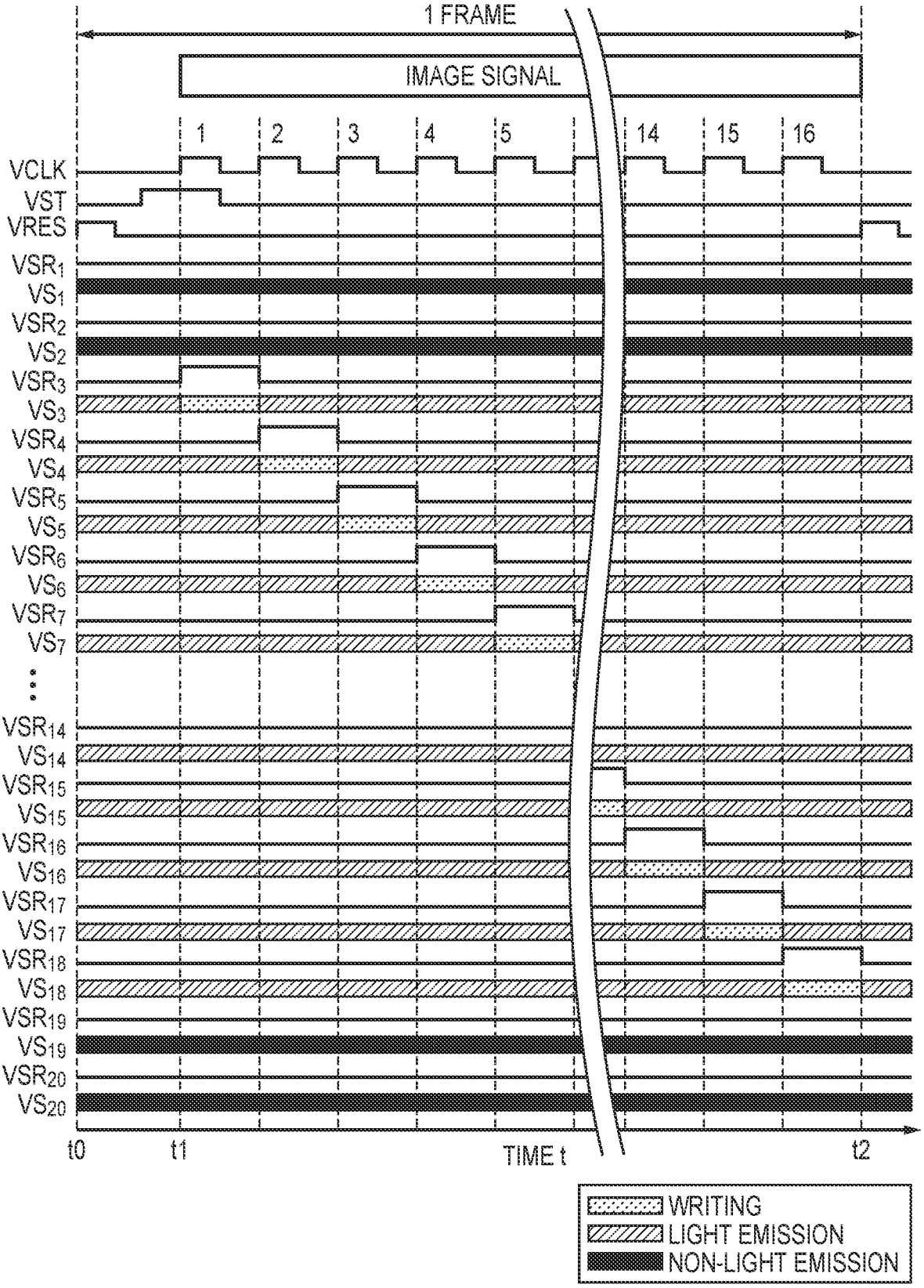
FIG. 4 is a timing chart showing an operation example of the display device shown in FIG. 1.
Figure 5:
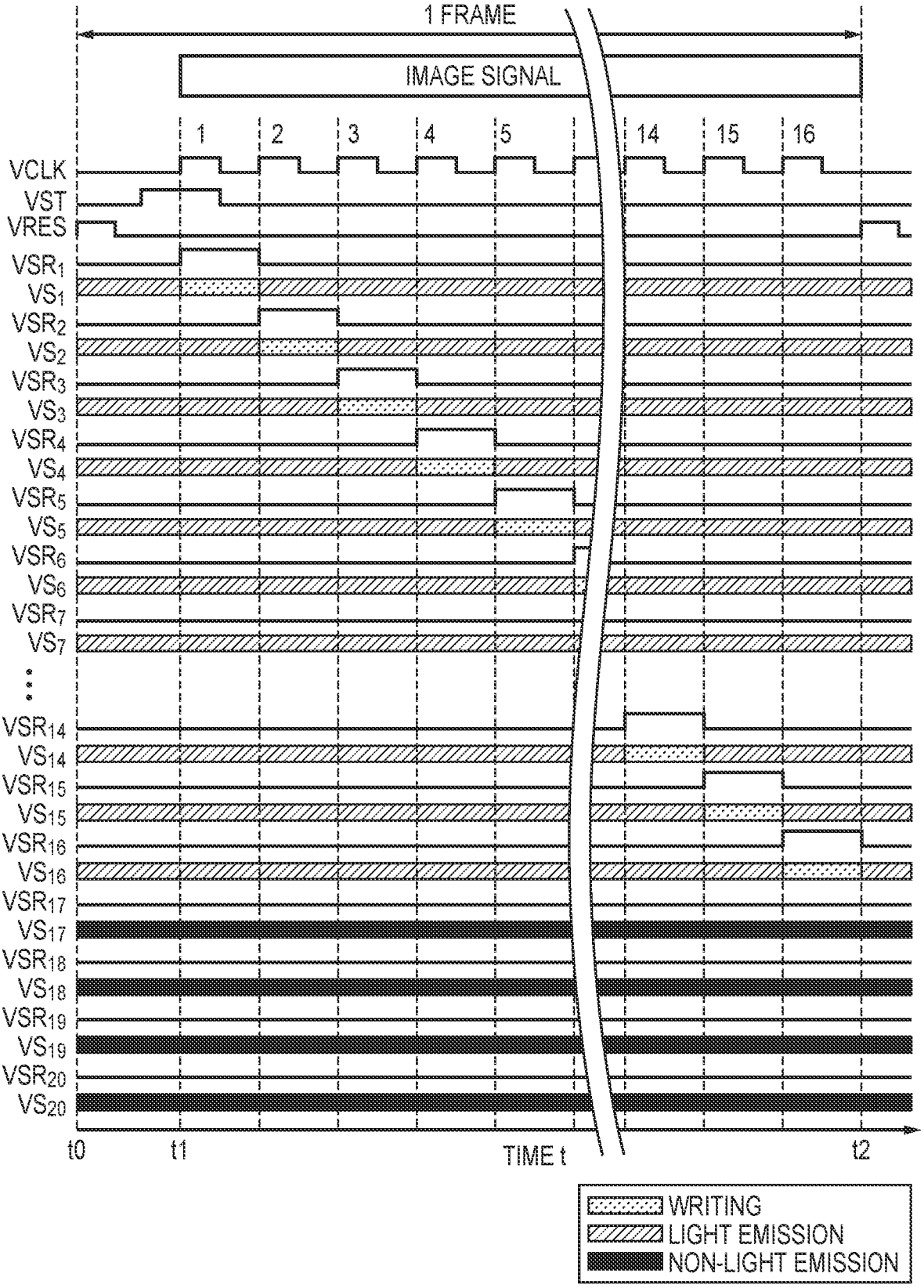
FIG. 5 is a timing chart showing an operation example of the display device shown in FIG. 1.
Figure 6:
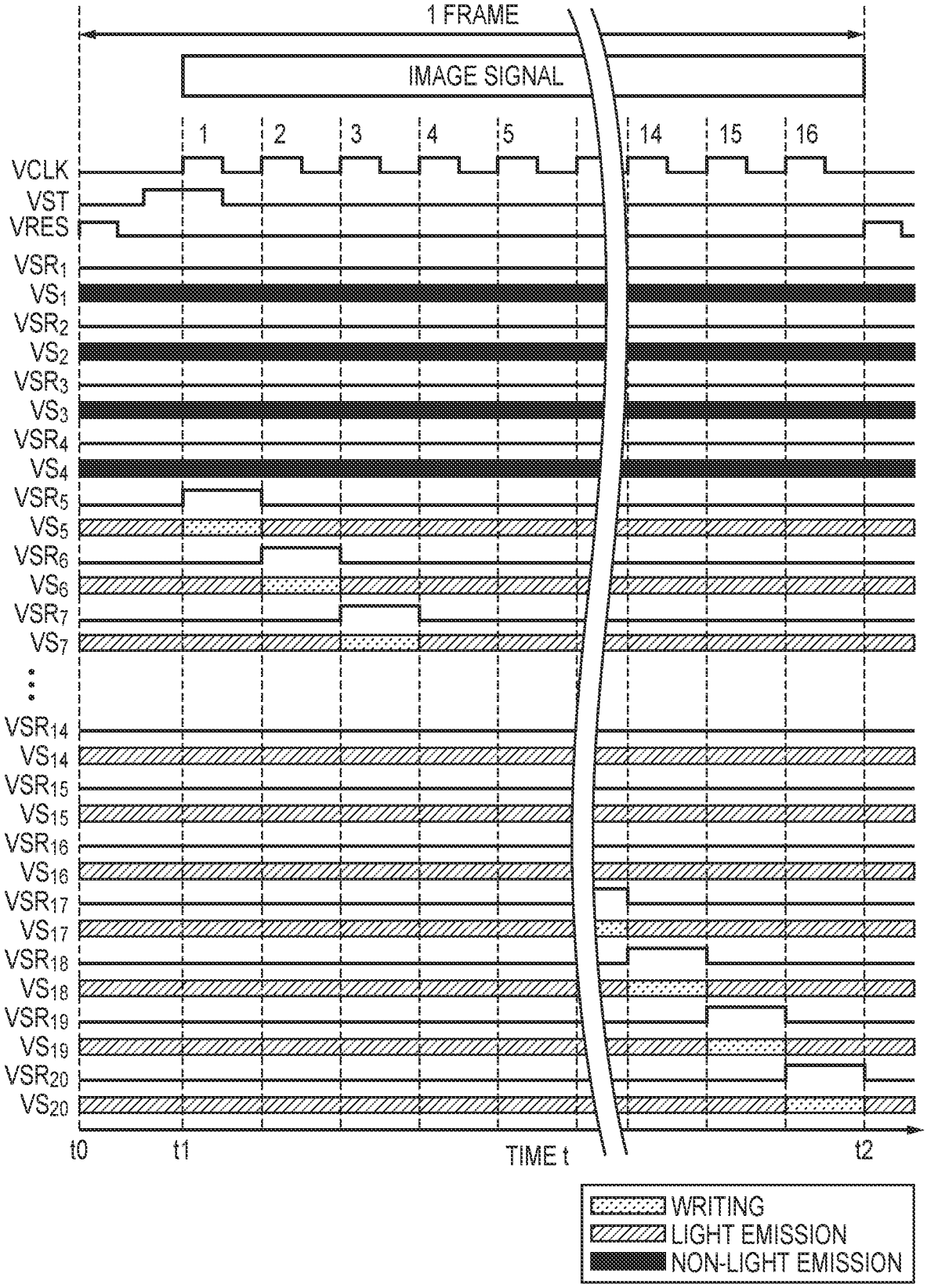
FIG. 6 is a timing chart showing an operation example of the display device shown in FIG. 1.

FIGS. 4 to 6 are timing charts showing the operation of the scanning circuit 20. FIG. 4 is a timing chart of a case in which the shift amount is ±0 rows, that is, the display area covers the third to 18th rows in the pixel array 10.

First, at time t0, the reset signal VRES transferred from the control circuit 40 becomes H level, and the outputs $VSR_1$ to $VSR_{20}$ of the shift register circuit 23 are reset to L level. Then, from time t1 after the reset signal VRES returns to L level, a periodic 16-clock clock signal VCLK is transferred from the control circuit 40. In the period from time t1 when the first clock of the clock signal VCLK is input to time t2 when the 16th clock is input, the image signals for 16 rows are supplied to the pixels 11 in the pixel array 10.

When the first clock of the clock signal VCLK at time t1 is input, the start pulse signal VST is transferred from the control circuit 40 so as to cover the rise of the clock signal VCLK. At this time, the shift register circuit 23 sets only the signal $VSR_3$ for the third row designated by the start designation circuit 21 to H level in synchronization with the clock signal VCLK. Based on the signal $VSR_3$, the light emission control circuit 24 outputs, as the scanning signal $VS_3$, a writing signal for setting the pixels 11 in a writing state. Thus, the shift register circuit 23 starts selection for writing the image signals from the initial line of the display area. As a result, the image signals are supplied from the signal output circuit 30 to the pixels 11 arranged in the third row via the signal lines 13 in the respective columns.

Subsequently, when the second clock of the clock signal VCLK from time t1 is input, the shift register circuit 23 shifts the output signal from the signal $VSR_3$ to the signal $VSR_4$ in synchronization with the rise of the clock signal VCLK. Similar to the first clock, the light emission control circuit 24 outputs the scanning signal $VS_4$ based on the signal $VSR_4$, so that the pixels 11 in the fourth row are selected and the image signals are written thereto. At this time, a light emission signal for setting the pixels 11 in a light emission state is output as the scanning signal $VS_3$ for the third row, so that the pixels 11 in the third row emit light with illuminance based on the written image signals.

Thereafter, the similar operation is repeated from the third clock to the 16th clock. That is, in one frame period (time t0 to time t2) for displaying one image, the shift register circuit 23 starts selection for writing the image signals starting from the initial line, and sequentially selects the rows between the initial line and the end line, so that the image signals are written in each row.

When the 16th clock is input, the pixels 11 in the 18th row are selected by the scanning signal $VS_{18}$, and the image signals are written thereto, the process advances to the next frame period at time t2. When moving to the second frame, the scanning circuit 20 repeats the operation from time t0 to time t2. The light emission control circuit 24 outputs, via the scanning signals $VS_3$ to $VS_{18}$, light emission signals for setting the pixels 11 in a light emission state for each row in which the image signals have been written. The light emission signals are kept output until the respective rows are selected for writing the image signals in the next frame period.

In addition, the light emission control circuit 24 outputs, via the scanning signals $VS_1$, $VS_2$, $VS_{19}$ and $VS_{20}$, non-light emission signals for setting the pixels 11 outside the display area in a non-light emission state. That is, the light emission control circuit 24 controls such that among the plurality of pixels 11, the pixels that are not arranged between the initial line and the end line are set in a non-light emission state. In this manner, the light emission control circuit 24 controls light emission or non-light emission of each of the plurality of pixels 11. The pixel 11 can include a self-luminous light emission element whose light emission or non-light emission state is controlled by the light emission control circuit 24. The pixel 11 may include, for example, an organic EL (electroluminescence) element as a light emission element.

In this embodiment, in one frame period for displaying one image, the scanning circuit 20 selects only rows for displaying the image in the display area and writes the image signals. Therefore, as compared with a case, as in Japanese Patent Laid-Open Nos. 2005-148558 and 2009-163172, in which the timing of outputting image signals from the signal output circuit 30 is adjusted while sequentially selecting the all rows in the pixel array 10, the time for writing image signals can be shortened. That is, in this embodiment, one frame period (time t0 to time t2) of the shift register circuit 23 is equal to an image signal input period (time t1 to time t2).

FIG. 5 is a timing chart of a case in which the image shift amount is −2 rows as shown in FIG. 2B, that is, the display area covers the first to 16th rows in the pixel array 10. The rows selected to write image signals and the rows to which light emission signals are output are different from those in the timing chart shown in FIG. 4. When the first clock of the clock signal VCLK is input, the signal $VSR_1$ becomes H level, the first row in the pixel array 10 is selected as the initial line via the scanning signal $VS_1$, and image signals are written in the pixels 11 in the first row. Thereafter, scanning is sequentially performed. When the 16th clock is input, the signal $VSR_{16}$ becomes H level, and image signals are written in the pixels 11 arranged in the 16th row in the pixel array 10. Further, the light emission control circuit 24 outputs non-light emission signals as the scanning signals $VS_{17}$ to $VS_{20}$ outside the display area.

FIG. 6 is a timing chart of a case in which the image shift amount is +2 rows as shown in FIG. 2C, that is, the display area covers the fifth to 20th rows in the pixel array 10. The rows selected to write image signals and the rows to which light emission signals are output are different from those in the timing charts shown in FIGS. 4 and 5. When the first clock of the clock signal VCLK is input, the signal $VSR_5$ becomes H level, the fifth row in the pixel array 10 is selected as the initial line via the scanning signal $VS_5$, and image signals are written in the pixels 11 in the fifth row. Thereafter, scanning is sequentially performed. When the 16th clock is input, the signal $VSR_{20}$ becomes H level, and image signals are written in the pixels 11 arranged in the 20th row in the pixel array 10. Further, the light emission control circuit 24 outputs non-light emission signals as the scanning signals $VS_1$ to $VS_4$ outside the display area.

With the above-described arrangement, regardless of the shift amount of the image display position, the shift register circuit 23 of the scanning circuit 20 can display an image by sequentially performing scanning only in the image signal input period. Therefore, one frame period (time t0 to time t2) of the shift register circuit 23 can be equal to an image signal writing period (time t1 to time t2). Thus, it is possible to realize the display device 1 that can suppress image retention by shifting the image display position, shorten one frame period, and operate at high-speed.

The shift of the display area for displaying an image in order to suppress image retention may be performed at an appropriate timing. For example, under the control from the control circuit 40, the start designation circuit 21 may shift the display area for displaying an image by shifting the position of the initial line in accordance with a lapse of time from the start of the image display. In this case, the control circuit 40 may incorporate a timer, or a timer may be provided in the display device 1 separately from the control circuit 40. In addition, for example, the start designation circuit 21 may shift the display area for displaying an image by shifting the position of the initial line in accordance with switching of the displayed image or the start or end of image display. Furthermore, for example, the start designation circuit 21 may shift the display area for displaying an image by shifting the position of the initial line in accordance with power-on or power-off of the display device 1. The control circuit 40 may shift the position of an image using one of these timings, or may shift the position of an image by combining some of them. For example, while operating a timer, if the image is switched before a predetermined time has elapsed, the control circuit 40 may cause the start designation circuit 21 to shift the position of the initial line.

Figure 7:
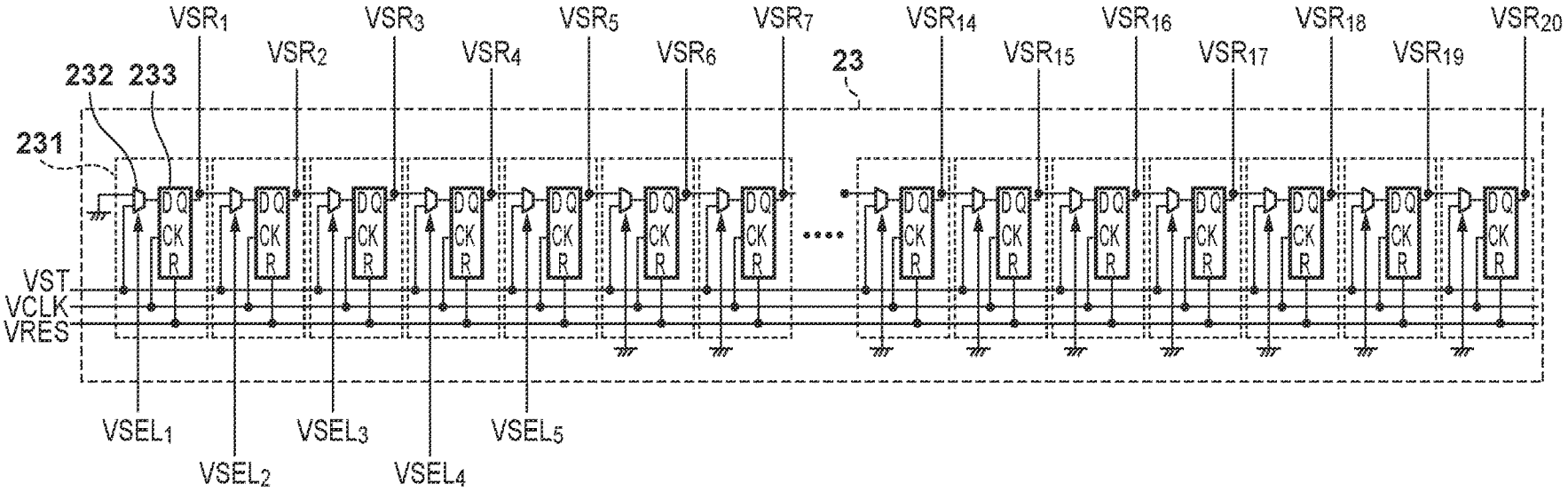
FIG. 7 is a circuit diagram showing an arrangement example of a shift register circuit of the scanning circuit shown in FIG. 3.

Next, the shift register circuit 23 will be described in detail with reference to FIG. 7. FIG. 7 is a circuit diagram showing an arrangement example of the shift register circuit 23 provided in the scanning circuit 20 of the display device 1.

In this embodiment, the shift register circuit 23 includes a plurality of shift register unit circuits 231 (unit circuits) arranged corresponding to the respective rows in the pixel array 10. The shift register unit circuit 231 includes a D flip-flop 233 and a multiplexer 232. In the D flip-flop 233 arranged in each shift register unit circuit 231, the clock signal VCLK and the reset signal VRES are input from the control circuit 40 to the clock input terminal and the reset input terminal, respectively. The signal output terminal of the D flip-flop 233 of the shift register unit circuit 231 for the nth row is connected to the signal input terminal of the multiplexer 232 of the shift register unit circuit 231 for the row ((n+1)th row) adjacent to the nth row on the 20th row side, and outputs the signal $VSR_n$. The signal output terminal of the multiplexer 232 of the shift register unit circuit 231 for nth row is connected to the signal input terminal of the D flip-flop 233 of the shift register unit circuit 231 for the same nth row. The start pulse signal VST and the signal $VSR_{n-1}$ for the row ((n−1)th row) adjacent to the nth row on the first row side are connected to the input of the multiplexer 232 for the nth row. Note that the start pulse signal VST and an L level signal are input to the multiplexer 232 for the first row in the pixel array 10.

The multiplexer 232 includes a control terminal. The multiplexer 232 selects the start pulse signal VST if the control terminal is in H level, and selects the other signal if the control terminal is in L level. In this embodiment, the selection signals $VSEL_1$ to $VSEL_5$ for designating the initial line are input from the start designation circuit 21 to the control terminals of the multiplexers 232 for the first to fifth rows each of which is to be the initial line, respectively. On the other hand, the L-level signals are input to the control terminals of the multiplexers 232 for the sixth to 20th rows each of which is not to be the initial line. Therefore, the signal $VSR_{n-1}$ is always connected to the input of each of the D flip-flops 233 for the sixth and subsequent rows.

Here, the start designation circuit 21 sets only the selection signal $VSEL_n$ for the row serving as the initial line of the display area for displaying an image to H level. In other words, the start designation circuit 21 transmits a signal (an H-level signal suppled as the selection signal $VSEL_n$) for designating the initial line to the multiplexer 232 of one shift register unit circuit 231 among the plurality of shift register unit circuits 231. For example, when the third row is the initial line, the selection signal $VSEL_3$ is set to H level, and the selection signals $VSEL_1$, $VSEL_2$, $VSEL_4$, and $VSEL_5$ are set to L level. Then, when the clock signal VCLK, the start pulse signal VST, and the reset signal VRES are input, the shift register circuit 23 can start to select the rows for writing the image signals starting from the initial line of the display area. That is, the shift register circuit 23 uses, as the initial line, the row connected to the shift register unit circuit 231 that has received a signal for designating the initial line among the plurality of shift register unit circuits 231.

In this embodiment, the start designation circuit 21 transmits a signal for designating the initial line to the shift register unit circuits 231 connected to the first to fifth rows each of which is to be the initial line, but the present invention is not limited to this. The connection may be appropriately determined in accordance with the arrangement of the pixel array 10 or an image to be displayed. In order to shift the display area for displaying an image, the start designation circuit 21 is only required to be configured to be able to transmit a signal for designating the initial line to at least two of the shift register unit circuits 231 among the plurality of shift register unit circuits 231. The at least two shift register unit circuits 231 can be connected to at least two continuous rows arranged in the end on the first row side in the pixel array 10. When displaying an image, the start designation circuit 21 transmits a signal for designating the initial line to one shift register unit circuit 231 of at least two shift register unit circuits 231. This enables the shift of the image display position.

Figure 8:
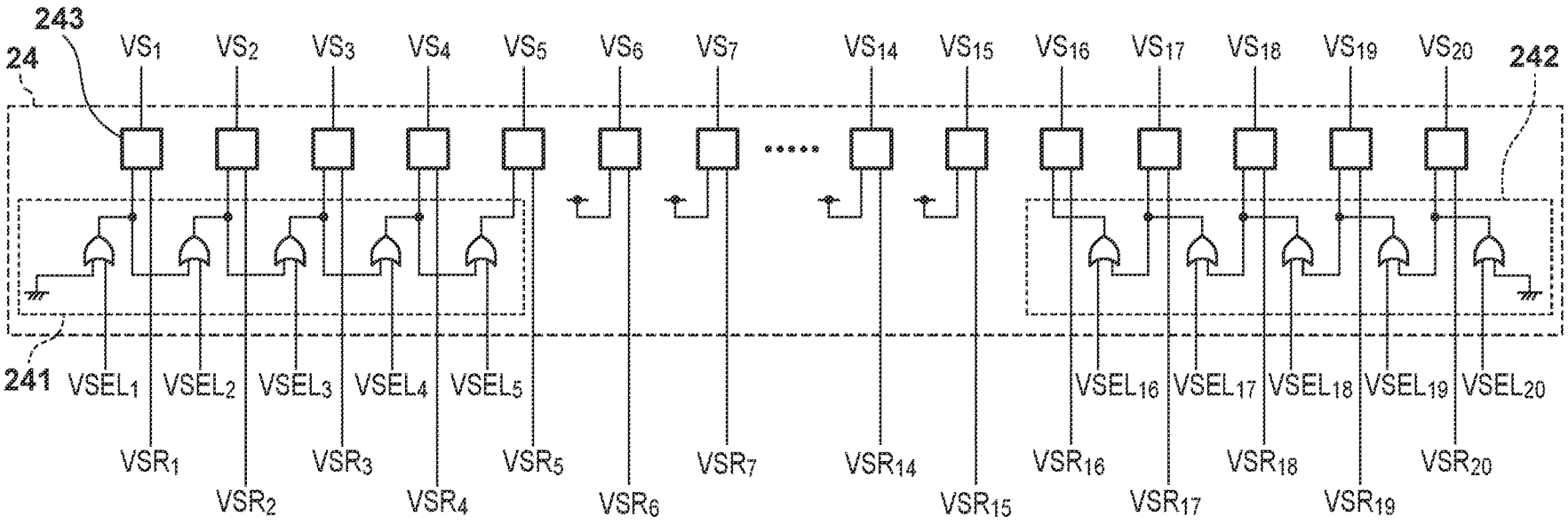
FIG. 8 is a circuit diagram showing an arrangement example of a light emission control circuit of the scanning circuit shown in FIG. 3.

Next, the details of the light emission control circuit 24 will be described with reference to FIG. 8. FIG. 8 is a circuit diagram showing an arrangement example of the light emission control circuit 24 provided in the scanning circuit 20 of the display device 1.

The light emission control circuit 24 includes an initial line-side control circuit 241, which is connected to the 0th to fifth rows each of which is to be the initial line of the display area for displaying an image, and an end line-side control circuit 242 connected to the 16th to 20th rows each of which is to be the end line. The control circuit 241 is connected to the rows connected to the shift register unit circuits 231, among the above-described shift register unit circuits 231, to which the signal for designating the initial line is transmitted from the start designation circuit 21. The light emission control circuit 24 further includes selection circuits 243 connected to the respective rows in the pixel array 10.

Each of the selection circuits 243 includes two control terminals and one output terminal. One of the signals $VSR_1$ to $VSR_{20}$ corresponding to the respective rows is input to a first control terminal of the two control terminals. A signal input to a second control terminal of the two control terminals changes for each row. The output signal of the control circuit 241 is input to the second control terminal of each of the selection circuits 243 connected to the 0th to fifth rows each of which is to be the initial line of the display area in this embodiment. The output signal of the control circuit 242 is input to the second control terminal of each of the selection circuits 243 connected to the 16th to 20th rows each of which is to be the end line of the display area in this embodiment. An H level signal is input to the second control terminal of each of the selection circuits 243 connected to the sixth to 15th rows that are arranged between the rows connected to the control circuit 241 and the control circuit 242 and will serve as neither the initial line nor the end line of the display area. The scanning signal $VS_n$ is output from the output terminal of the selection circuit 243.

When an L-level signal is input to the second control terminal, the selection circuit 243 outputs a non-light emission signal as the scanning signal $VS_n$. On the other hand, when an H-level signal is input to the second control terminal, a writing signal is output if the first control terminal is at H level, and a light emission signal is output if the first control terminal is at L level.

Here, the control circuit 241 and the control circuit 242 are controlled by the start designation circuit 21 and the end designation circuit 22, respectively. The start designation circuit 21 outputs the selection signals $VSEL_0$ to $SVEL_5$, and sets the selection level signal $VSEL_n$ corresponding to the initial line to H level. Similarly, the end designation circuit 22 outputs the selection signals $VSEL_{16}$ to $VSEL_{20}$, and sets the selection signal $VSEL_n$ corresponding to the end line to H level. If an H-level signal is input to the initial line, the control circuit 241 outputs H-level signals to the rows succeeding the initial line. For example, when the initial line is the third row, L-level signals are output to the first and second rows, and H-level signals are output to the third to fifth rows. Also, if an H-level signal is input to the end line, the control circuit 242 outputs H-level signals to the rows preceding the end line. For example, when the end line is the 18th row, H-level signals are output to the 16th to 18th rows, and L-level signals are output to the 19th and 20th rows.

As a result, the second control terminals of the selection circuits 243 for the rows within the display area receive the H-level signals, and the second control terminals of the selection circuits 243 for the rows outside the display area receive the L-level signals. Thus, it is possible to sequentially control the writing and light emission of the pixels 11 arranged in the rows serving as the display area based on the signal $VSR_n$. Further, the pixels 11 outside the display area can be controlled to emit no light.

That is, the control circuit 241 is configured to be able to receive a signal for designating the initial line from the start designation circuit 21, and controls the rows, among the rows connected to the control circuit 241, preceding the initial line on the first row side to be set in the non-light emission state. Further, the control circuit 241 controls the initial line and the rows, among the rows connected to the control circuit 241, succeeding the initial line on the 20th row side to be set in the light emission state. On the other hand, the control circuit 242 is configured to be able to receive a signal for designating the end line from the end designation circuit 22, and controls the rows, among the rows connected to the control circuit 242, succeeding the end line on the 20th row side to be set in the non-light emission state. Further, the control circuit 242 controls the end line and the rows, among the rows connected to the control circuit 242, preceding the end line on the first row side to be set in the light emission state.

As an example of a circuit that realizes the control circuits 241 and 242 described above, the circuit arrangement using an OR gate as shown in FIG. 8 is conceivable. In the control circuit 241, an output from the OR gate for the (n−1)th row and the selection signal $VSEL_n$ for the nth row are input to the OR gate for the nth row. Note that an L-level input and the selection signal $VSEL_n$ are input to the OR gate for the first row. Further, in the control circuit 242, an output from the OR gate for the (n+1)th row and the selection signal $VSEL_n$ for the nth row are input to the OR gate for the nth row. Note that an L-level input and the selection signal $VSEL_{20}$ are input to the OR gate for the 20th row. The circuit described herein is an example, and any circuit may be used as long as it realizes this function.

Also, in this embodiment, the control circuit 241 is connected to the first to fifth rows each of which is to be the initial line, but the present invention is not limited to this. The connection may be appropriately determined in accordance with the arrangement of the pixel array 10 or an image to be displayed. In order to shift the display area to display an image, the control circuit 241 is only required to be connected to at least two continuous rows arranged in the end on the first row side in the pixel array 10. Further, the control circuit 242 is only required to be connected to at least two continuous rows arranged in the end on the 20th row side in the pixel array 10. At this time, the rows connected to the control circuit 241 can be connected to the rows that are connected to the shift register unit circuits 231 that receive a signal for designating the initial line from the start designation circuit 21.

The embodiment according to the present invention has been described above. However, the present invention is not limited to the above embodiment, as a matter of course, and the embodiment described above can be modified and combined as appropriate without departing from the scope of the present invention.

The display device 1 as described above can be incorporated in various electronic equipment. Examples of such electronic equipment can include, for example, a camera, a computer, a mobile terminal, an onboard display device, and the like. The electronic equipment can include, for example, the display device 1, and a control unit that controls driving of the display device 1.

Figure 9:
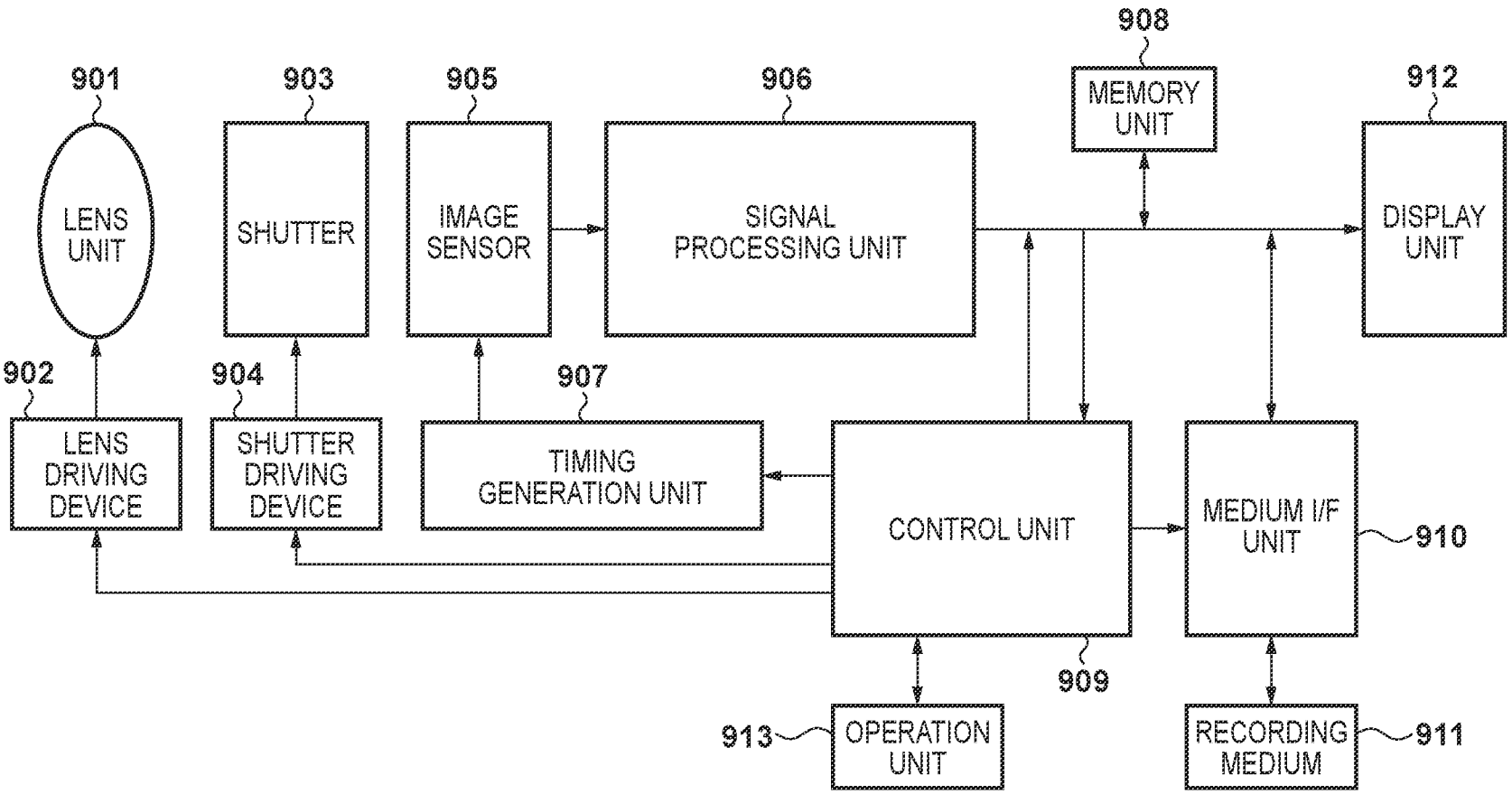
FIG. 9 is a block diagram showing an arrangement example of a camera using the display device shown in FIG. 1.

Here, an embodiment in which the display device 1 described above is applied to the display unit of a digital camera will be described with reference to FIG. 9. A lens unit 901 is an imaging optical system that forms an optical image of an object on an image sensor 905, and includes a focus lens, a magnification lens, a stop, and the like. Driving of the focus lens position, the magnification lens position, the aperture diameter of the stop, and the like in the lens unit 901 is controlled by a control unit 909 via a lens driving device 902.

A mechanical shutter 903 is arranged between the lens unit 901 and the image sensor 905, and driving thereof is controlled by the control unit 909 via a shutter driving device 904. The image sensor 905 converts the optical image formed by a plurality of pixels in the lens unit 901 into an image signal. A signal processing unit 906 performs A/D conversion, de-mosaic processing, white balance adjustment processing, encoding processing, and the like on the image signal output from the image sensor 905.

A timing generation unit 907 outputs various types of timing signals to the image sensor 905 and the signal processing unit 906. The control unit 909 includes, for example, memories (ROM and RAM) and a microprocessor (CPU). When the programs stored in the ROM are loaded to the RAM and executed by the CPU to control the respective units, the various types of functions of the digital camera are implemented. The functions implemented by the control unit 909 include automatic focus detection (AF) and automatic exposure control (AE).

A memory unit 908 is used by the control unit 909 and the signal processing unit 906 to temporarily store image data or as a work area. A medium I/F unit 910 is an interface for performing reading and writing of a recording medium 911 which is a removable memory card, for example. A display unit 912 displays a captured image and various kinds of information of the digital camera. The display device 1 described above can be applied to the display unit 912. The display device 1 mounted in the digital camera as the display unit 912 is driven by the control unit 909 and displays an image and various kinds of information. An operation unit 913 is a user interface, such as s power switch, a release button, and a menu button, for a user to give instructions and settings to the digital camera.

Next, the operation of the digital camera at the time of capturing will be described. When the power is turned on, a capturing standby state is set. The control unit 909 starts display processing for displaying an image or various kinds of information on the display unit 912 (display device 1). At this time, for example, the same character or pattern tends to be displayed at the same position for a long time on a screen for performing various settings of the digital camera. Therefore, the character or pattern may be retained. By shifting the image display position as described above, image retention can be suppressed. Further, for example, in an electronic viewfinder or the like, in addition to an image obtained by the image sensor 905, information such as capturing conditions and a remaining battery level may be displayed. In these pieces of information, the character or pattern tends to be displayed at the same position for a long time. Then, an image obtained by the image sensor 905 may be always displayed in a predetermined area of the pixel array 10, and the display of information such as capturing conditions may be shifted as described above.

If a capturing preparation instruction (for example, half-pressing of the release button of the operation unit 913) is input in the capturing standby state, the control unit 909 starts focus detection processing. Then, the control unit 909 calculates the moving amount and moving direction of the focus lens of the lens unit 901 from the obtained defocus amount and direction, drives the focus lens via the lens driving device 902, and adjusts the focus of the imaging optical system. After the driving, if necessary, focus detection based on a contrast evaluation value may be further performed to finely adjust the focus lens position.

Thereafter, if a capturing start instruction (for example, full-pressing of the release button) is input, the control unit 909 executes a capturing operation for recording, and the obtained image data is processed by the signal processing unit 906 and stored in the memory unit 908. Then, the control unit 909 records the image stored in the memory unit 908 in the recording medium 911 via the medium OF unit 910. At this time, the control unit 909 may drive the display unit 912 (display device 1) to display the captured image. The control unit 909 may output the image data from an external I/F unit (not shown) to an external apparatus such as a computer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-209929, filed on Nov. 7, 2018, which is hereby incorporated by reference herein in its entirety.

What is claimed is:

1. A display device comprising:

a pixel array including a plurality of pixels arranged in a matrix;

a scanning circuit configured to select a row in the pixel array; and a signal output circuit configured to supply image signals to the pixels, among the plurality of pixels, arranged in the row selected by the scanning circuit, wherein the device displays an image using the pixels arranged between an initial line and an end line, the initial line being arranged on a first line in the pixel array or being arranged between the first line and a last line in the pixel array, and the end line being arranged on the last line or being arranged between the initial line and the last line, wherein the scanning circuit includes (a) a start designation circuit configured to designate the initial line, and (b) an end designation circuit configured to designate the end line, wherein the scanning circuit includes a first control circuit connected to at least two continuous rows from the first line to a second line in the pixel array, wherein the first control circuit is configured (a) to be able to receive a signal for designating the initial line from the start designation circuit, (b) to control rows from the initial line to the second line, among the rows connected to the first control circuit, to be set in a light emission state, and (c) to control rows other than the rows from the initial line to the second line, among the rows connected to the first control circuit, to be set in a non-light emission state, wherein the scanning circuit includes a shift register circuit, wherein the shift register circuit is configured to (1) start, from the initial line, selection for writing the image signals, and (2) sequentially select the rows between the initial line and the end line, in one frame period for displaying one image, wherein the scanning circuit further includes a light emission control circuit configured to control light emission or non-light emission of each of the plurality of pixels, and wherein the light emission control circuit controls the pixels, among the plurality of pixels, that are not arranged between the initial line and the end line to be set in the non-light emission state, wherein the light emission control circuit further includes a second control circuit connected to at least two continuous rows from the last line to a third line in the pixel array, and wherein the second control circuit is configured (a) to be able to receive a signal for designating the end line from the end designation circuit, (b) to control rows from the third line to the end line, among the rows connected to the second control circuit, to be set in the light emission state, and (c) to control rows other than the rows from the third line to the end line, among the rows connected to the second control circuit, to be set in the non-light emission state.

2. The device according to claim 1, wherein the start designation circuit shifts a position of the initial line in accordance with at least one of a lapse of time from a start of image display, switching of a displayed image, a start or an end of image display, and power-on or power-off of the display device.

3. The device according to claim 1, wherein the shift register circuit includes a plurality of unit circuits arranged corresponding to respective rows in the pixel array, wherein the start designation circuit transmits a signal for designating the initial line to one unit circuit of the plurality of unit circuits, and wherein the shift register circuit sets, as the initial line, the row connected to the unit circuit, among the plurality of unit circuits, that has received the signal for designating the initial line.

4. The device according to claim 3, wherein each of the plurality of unit circuits includes a D flip-flop and a multiplexer, wherein a signal output terminal of the multiplexer of the unit circuit for the nth row among the plurality of unit circuits is connected to a signal input terminal of the D flip-flop of the unit circuit for the nth row, wherein a signal output terminal of the D flip-flop of the unit circuit for the nth row is connected to a signal input terminal of the multiplexer of the unit circuit for a row adjacent to the nth row on the other end side, and wherein when the signal for designating the initial line is input from the start designation circuit to a control terminal of the multiplexer of the unit circuit, among the plurality of unit circuits, connected to a row to be the initial line, selection for writing the image signals is started from the row.

5. The device according to claim 3, wherein the start designation circuit is configured to be able to transmit the signal for designating the initial line to at least two unit circuits of the plurality of unit circuits, wherein when an image is to be displayed, the start designation circuit transmits the signal for designating the initial line to one of the at least two unit circuits, and wherein the at least two unit circuits are connected to at least two continuous rows arranged in an end on the one end side in the pixel array.

6. The device according to claim 5, wherein the scanning circuit further includes a light emission control circuit configured to control light emission or non-light emission of each of the plurality of pixels, wherein the light emission control circuit controls the pixels, among the plurality of pixels, that are not arranged between the initial line and the end line to be set in the non-light emission state, wherein the light emission control circuit includes a second control circuit connected to at least two continuous rows from the last line to a third line in the pixel array, and wherein the second control circuit is configured (a) to be able to receive a signal for designating the end line from the end designation circuit, (b) to control rows from the third line to the end line, among the rows connected to the second control circuit, to be set in the light emission state, and (c) to control rows other than the rows from the third line to the end line, among the rows connected to the second control circuit, to be set in the non-light emission state.

7. The device according to claim 1, wherein the light emission control circuit controls the rows arranged between the rows connected to the first control circuit and the second control circuit to be set in the light emission state.

8. The device according to claim 1, wherein the device displays an image using some continuous rows in the pixel array.

9. The device according to claim 1, wherein a row serving as the initial line in the pixel array includes a row different from the first line.

10. The device according to claim 1, wherein a row serving as the end line in the pixel array includes a row different from the last line.

11. Electronic equipment including:

a display device according to claim 1; and a control unit configured to control driving of the display device.

12. The device according to claim 1, wherein the plurality of pixels includes non-light-emitting pixels other than the plurality of pixels arranged between the initial line and the end line.

13. The device according to claim 1, wherein in a first display mode, the start designation circuit designates, as the initial line, a fourth line in the pixel array, and wherein in a second display mode, the start designation circuit designates, as the initial line, a fifth line in the pixel array, the fourth line being different from the fifth line.

14. A display device comprising:

a pixel array including a plurality of pixels arranged in a matrix;

a scanning circuit configured to select a row in the pixel array; and a signal output circuit configured to supply image signals to the pixels, among the plurality of pixels, arranged in the row selected by the scanning circuit, wherein the device displays an image using the pixels arranged between an initial line on one end side in the pixel array and an end line succeeding the initial line on the other end side, wherein the scanning circuit includes (a) a start designation circuit configured to designate the initial line, (b) an end designation circuit configured to designate the end line, and (c) a shift register circuit, wherein the shift register circuit is configured to (1) start, from the initial line, selection for writing the image signals, and (2) sequentially select the rows between the initial line and the end line, in one frame period for displaying one image, wherein the shift register circuit includes a plurality of unit circuits arranged corresponding to respective rows in the pixel array, wherein the start designation circuit transmits a signal for designating the initial line to one unit circuit of the plurality of unit circuits, wherein the shift register circuit sets, as the initial line, the row connected to the unit circuit, among the plurality of unit circuits, that has received the signal for designating the initial line, wherein each of the plurality of unit circuits includes a D flip flop and a multiplexer, wherein a signal output terminal of the multiplexer of the unit circuit for the nth row among the plurality of unit circuits is connected to a signal input terminal of the D flip-flop of the unit circuit for the nth row, wherein a signal output terminal of the D flip-flop of the unit circuit for the nth row is connected to a signal input terminal of the multiplexer of the unit circuit for a row adjacent to the nth row on the other end side, and wherein when the signal for designating the initial line is input from the start designation circuit to a control terminal of the multiplexer of the unit circuit, among the plurality of unit circuits, connected to a row to be the initial line, selection for writing the image signals is started from the row.

15. A display device comprising:

a pixel array including a plurality of pixels arranged in a matrix;

a scanning circuit configured to select a row in the pixel array; and a signal output circuit configured to supply image signals to the pixels, among the plurality of pixels, arranged in the row selected by the scanning circuit, wherein the device displays an image using the pixels arranged between an initial line on one end side in the pixel array and an end line succeeding the initial line on the other end side, wherein the scanning circuit includes (a) a start designation circuit configured to designate the initial line, (b) an end designation circuit configured to designate the end line, and (c) a shift register circuit, and wherein the shift register circuit is configured to (1) start, from the initial line, selection for writing the image signals, and (2) sequentially select the rows between the initial line and the end line, in one frame period for displaying one image, wherein the scanning circuit further includes a light emission control circuit configured to control light emission or non-light emission of each of the plurality of pixels, wherein the light emission control circuit controls the pixels, among the plurality of pixels, that are not arranged between the initial line and the end line to be set in a non-light emission state, wherein the light emission control circuit includes a first control circuit connected to at least two continuous rows arranged in an end on the one end side in the pixel array, and a second control circuit connected to at least two continuous rows arranged in an end on the other end side in the pixel array, wherein the first control circuit is configured (a) to be able to receive the signal for designating the initial line from the start designation circuit, (b) to control the row, among the rows connected to the first control circuit, preceding the initial line on the one end side to be set in the non-light emission state, and (c) to control the initial line and the row succeeding the initial line on the other end side, among the rows connected to the first control circuit, to be set in a light emission state, and wherein the second control circuit is configured (a) to be able to receive a signal for designating the end line from the end designation circuit, (b) to control the row, among the rows connected to the second control circuit, succeeding the end line on the other end side to be set in the non-light emission state, and (c) to control the end line and the row preceding the end line on the one end side, among the rows connected to the second control circuit, to be set in the light emission state.

* * * * *